United States Patent [19]

Jacobs et al.

[11] Patent Number: 4,722,150

[45] Date of Patent: Feb. 2, 1988

[54] SLIDING DOOR GUIDE

[75] Inventors: Kenneth Jacobs, Esher; Auguste J. Menard, Swindon, both of England

[73] Assignee: Acme General Corporation, San Dimas, Calif.

[21] Appl. No.: 829,701

[22] Filed: Feb. 14, 1986

[30] Foreign Application Priority Data

| | | | |
|---|---|---|---|
| Feb. 15, 1985 | [GB] | United Kingdom | 8503928 |
| Mar. 27, 1985 | [GB] | United Kingdom | 8507922 |
| Jun. 21, 1985 | [GB] | United Kingdom | 8515776 |

[51] Int. Cl.[4] ..... E05D 15/06

[52] U.S. Cl. ..... 49/425; 16/98; 16/91; 384/10; 384/50; 384/58

[58] Field of Search ..... 49/425, 426, 427, 420, 49/404, 410, 411, 36, 415, 419, 424, 439, 452, 453; 384/7, 10, 50, 53, 51, 57, 58; 16/91, 97, 98, 101

[56] References Cited

U.S. PATENT DOCUMENTS

| | | | |
|---|---|---|---|
| 1,274,872 | 8/1918 | Gordon | 49/425 |
| 2,650,387 | 9/1953 | Foss | 16/91 |
| 2,822,215 | 2/1958 | Blanton | 49/425 |
| 2,971,228 | 2/1961 | Szabo | 49/425 |
| 3,093,424 | 6/1963 | Pernetta | 384/10 |
| 4,573,286 | 3/1986 | Faurel | 49/425 |

FOREIGN PATENT DOCUMENTS

| | | | |
|---|---|---|---|
| 247929 | 4/1963 | Australia | 49/425 |
| 576786 | 6/1959 | Canada | 49/425 |
| 7701602 | 8/1978 | Netherlands | 16/91 |

*Primary Examiner*—Kenneth J. Dorner
*Assistant Examiner*—Gerald A. Anderson
*Attorney, Agent, or Firm*—Christie, Parker & Hale

[57] ABSTRACT

A slider (41) for guiding the top of a sliding door (12) in a channel (42) comprises spaced cheeks (56) between which extends a rib (59) which engages one side of the channel, and flexible tongue (60) which flexes between the cheeks and is thereby biased into engagement with the other side of the channel. Another embodiment of door guide has a pair of wheels (113, 114) having enlarged rims at one end for engaging opposite walls of a door guiding channel. One of the wheels is inverted relative to the other. Thus, the rim of one wheel is at a higher elevation than the rim of the other wheel.

25 Claims, 12 Drawing Figures

SLIDING DOOR GUIDE

BACKGROUND OF THE INVENTION

This invention is concerned with improvements in and relating to sliding doors and particularly to such doors as are commonly used to close off wardrobes, wall cupboards and the like.

Sliding doors are extensively used in closets, wardrobes, wall cupboards and the like because of their space saving features, yet in many applications the door size required is non-standard and the door must then be tailor made from simple stock parts. When fitted, however, the user demands a smooth positive movement, which is neither "sloppy" nor "sticky". It is also significant that the door slide quietly in the channel that guides it.

It is an object of the present invention to provide an improved sliding door that is simple to assemble but yet has a smooth movement.

BRIEF SUMMARY OF THE INVENTION

There is, therefore, provided in practice of this invention a guide for having a body for connection to a sliding door. A pair of wheels are mounted on the body for rotation about vertical axes spaced apart in a direction transverse to the plane of the door for engaging opposite sides of a door guiding channel. The rim of one wheel engages a wall of the channel at a higher elevation and the other wheel engages the other wall of the channel at a lower elevation. In a preferred embodiment each of the wheels has a relatively wider rim at one end and a narrower base at the other end, with one of the wheels being upright and the other inverted. Preferably the rims of the wheels are deformable on engagement with the sides of the channel.

The present invention also concerns a slider for guiding the top of a sliding door in a channel and comprising cheeks spaced apart in a first direction and interconnected by a first rib and a web, a tongue extending in a second direction between the cheeks and flexible about an axis extending in the first direction between the cheeks and a second rib parallel with the first and located at the free end of the tongue beyond the cheeks, the ribs being spaced apart in the second direction by a distance greater than the maximum dimension of the cheeks in the second direction.

BRIEF DESCRIPTION OF THE DRAWINGS

An embodiment of the present invention will now be described, by way of example, with reference to the accompanying drawings, in which.

DETAILED DESCRIPTION

Figure 1:
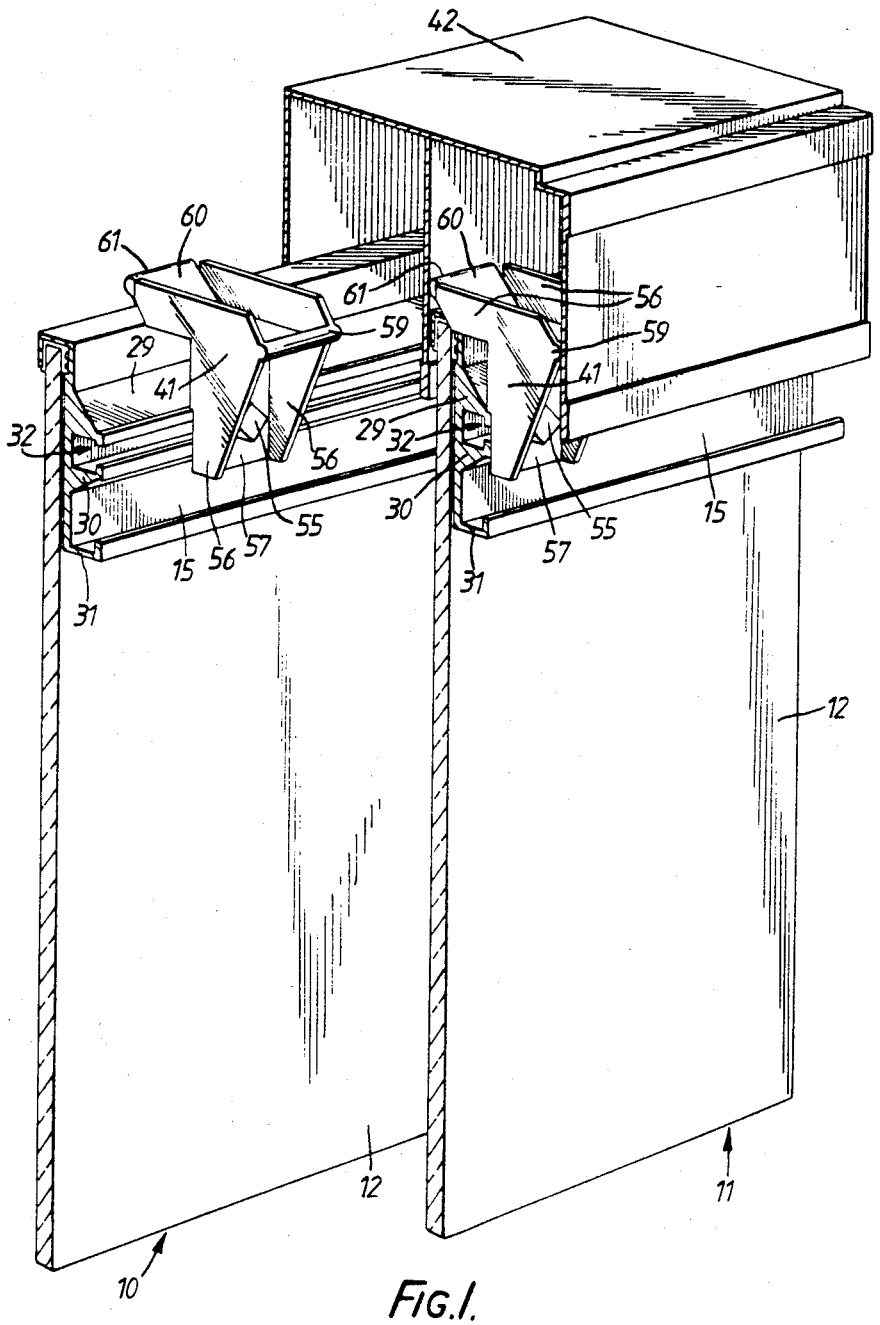
FIG. 1 is a rear perspective view, partly broken away, showing the location of sliders within a top channel extrusion and their mounting on two sliding doors.
Figure 2:
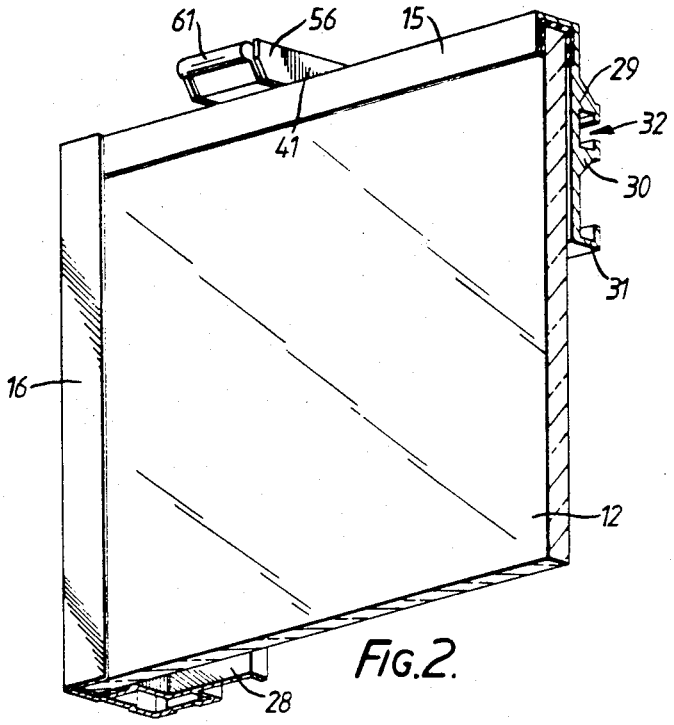
FIG. 2 is a front perspective view of a corner of a door as shown in FIG. 1.

Referring now to the drawings, two sliding doors 10 and 11, typically mounted at the front of a cupboard or wardrobe space, each comprises an infill panel 12 within an external frame comprising a top rail 15, side stiles 16 and 17 and a bottom rail 18. The rails and stiles are aluminium extrusions and the infill panel, which in this embodiment is a mirror but could be a wooden or other decorative panel, is secured in grooves in the rails and stiles.

Figure 5:
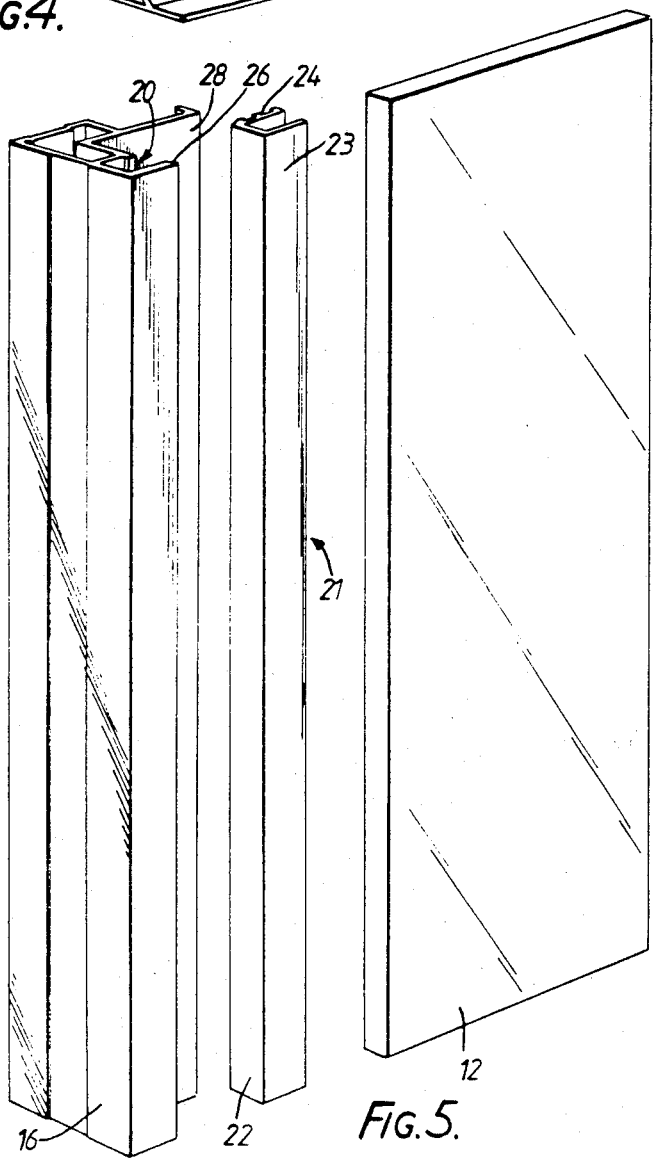
FIG. 5 is an exploded perspective view showing the fitting of an infill panel to a stile.

Considering FIG. 5, the stile 16 is provided at its front with a channel 20 which runs the length of the stile and which receives a gasket 21 in which is located the edge of the panel 12. The gasket 21 is substantially U-shaped in cross section having a base 22 which engages the edge surface of the panel 12, a first limb 23 which engages the front of the panel 12 and a second limb 24 which engages the rear of the panel. The first limb of the gasket is thinner than the second limb to reduce its visibility when the door is viewed from the front, and this effect is enhanced by a thin extrusion lip 26 at the front of the channel 20 which serves further to conceal the gasket and thus improve the appearance of the door. The stile 17 (FIG. 6), and the top and bottom rails have similar channels embracing similar gaskets and the respective edges of the panel 12.

The stiles 16 and 17 are mirror images of each other and have inwardly extending flanges 28 which overlie three rearwardly projecting longitudinal walls 29, 30 and 31 on each of the top and bottom rails 15 and 18, the rails also being mirror images of each other. Two of these walls, 29 and 30, are near the center of the rails and define a channel 32 partially closed at its open side by flanges 33 and 34 at the top of the walls 29 and 30. The external appearance of the stiles may be modified as desired, and in particular may incorporate a finger grip.

Figure 3:
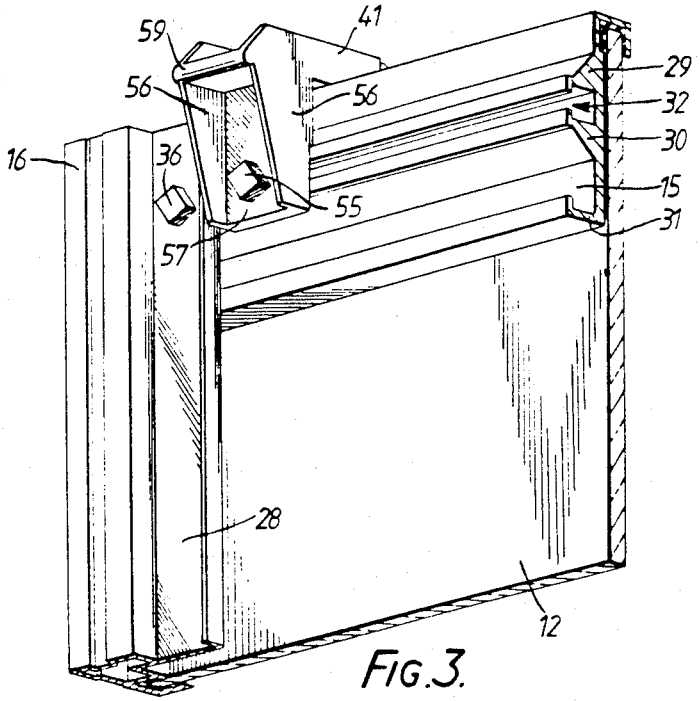
FIG. 3 is a rear perspective view of a corner of a door as shown in FIG. 1.
Figure 4:
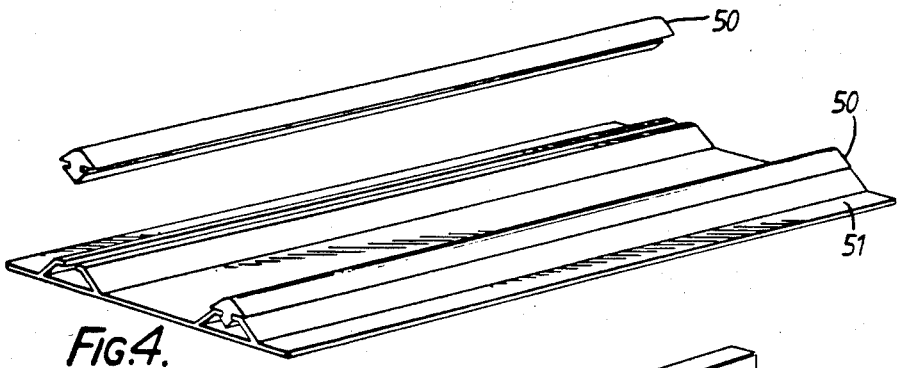
FIG. 4 is a perspective view of a bottom track extrusion.

The top rail 15 is secured to each of the two stiles by means of a bolt 36 which passes throug the flange 28 (FIG. 3) on the stile and between the flanges 33 and 34 and engages a nut (not illustrated) which is trapped in the channel 32 by the flanges 33 and 34. When the bolt 36 is tightened the stile is firmly secured to the top rail, the flange 28 lying across and engaging the top of all three walls 29, 30 and 31.

Figure 6:
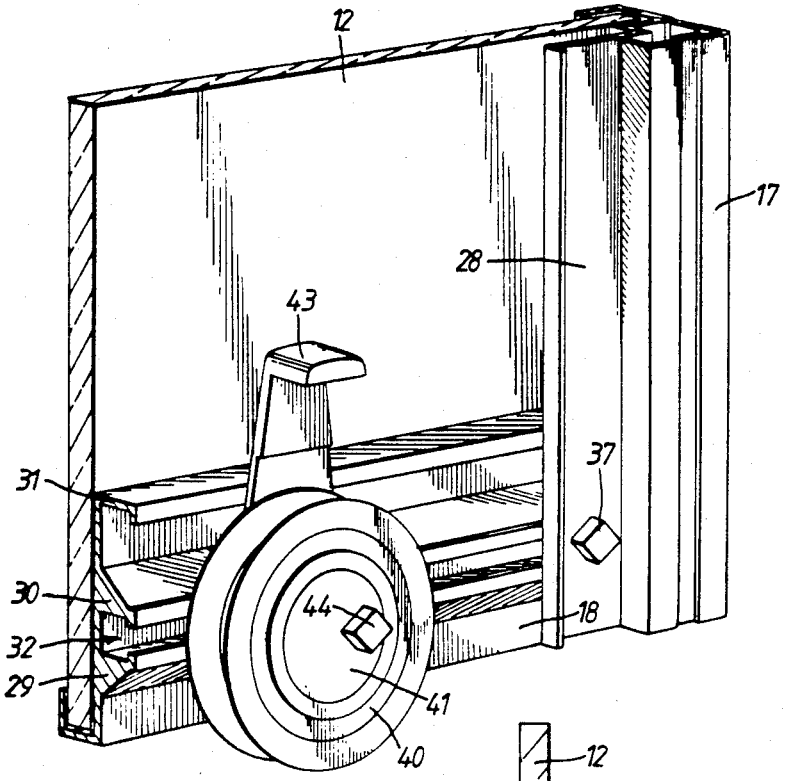
FIG. 6 is a perspective view of part of the bottom door extrusion showing a wheel mounted on the extrusion.

In the same manner the bottom rail 18 is secured to each of the stiles 16 and 17 by a bolt 37 (FIG. 6).

Each of the doors 10 and 11 is supported by wheels 40 secured to the bottom rail 18 and is guided at the top by sliders or guides 41 secured to the top rail 14 and engaging the sides of one of the two parallel channels in a channel member 42 of substantially E-shaped cross section. The channel member 42 is of course secured at the top of the opening to be closed by the doors and is also an extruded aluminium section.

Figure 7:
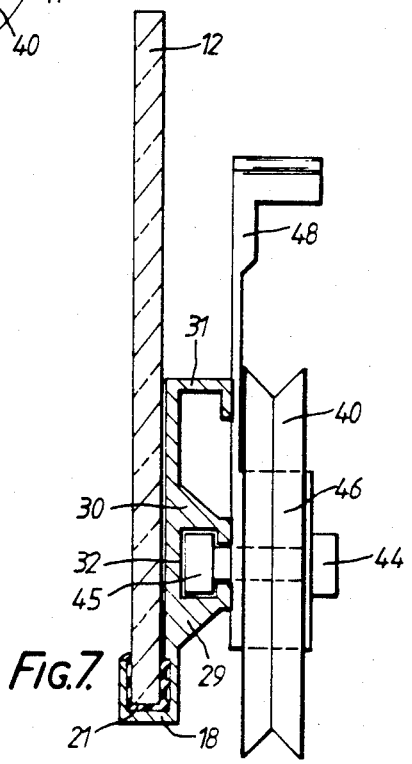
FIG. 7 is a cross section through the wheel of FIG. 6.

As seen best in FIG. 7, each wheel 40 rotates on a boss 46 which is formed integrally with a lever 48. An eccentric hole in the boss receives a bolt 44 which engages a nut 45 in the channel 32 in the bottom rail 18. It can be seen that by moving the lever 48 the boss 46 is rotated about the bolt 44 to raise or lower the wheel relative to the door and thus adjust the door mounting. This adjustment is of course made before the bolt 44 is fully tightened.

The wheel 40, being made of metal such as steel or a hard plastics material, such as nylon, has a relatively hard surface and runs on a rubber rail 50 secured to a bottom track extrusion 51 which in turn is fastened across the bottom of the opening to be closed by the doors. As the periphery of the wheel is grooved and the track 50 has a triangular cross section, the wheels are self aligning on the track. It should also be noted that in the closed position of the doors, i.e. the normal position, the weight of the door will tend to cause the wheels to deform the track and create a depression which serves in time to locate the doors in the closed position.

As seen best in FIG. 1 the guides 41 are connected to the top rail of the respective door by means of a bolt 55 cooperating with a nut located in the channel 32. Each slider 41 comprises two cheeks 56 interconnected by a web 57 through which passes the bolt 55, and a rib 59 located at the rearmost point of the cheeks 56. The rearwardly facing surfaces of the cheeks 56 are inclined to reach a peak where the rib 59 is mounted. The top edge of the web 57 forms the pivot axis for a tongue 60 which projects forwardly from the axis and terminates in front of the surface of the door in a rib 61. The sides of the tongue 60 are free to move between the cheeks 56.

In use, as can be seen in FIG. 1, the rib 59 engages the rear surface of the channel in which the slider moves while the rib 61 on the tongue 60 engages the front surface of the channel. Because the rib 61 is mounted on the flexible tongue 60 which is forced upwardly as the slider is located in the channel, the rib 61 is biased against the surface of the channel to ensure that both ribs remain in contact with the channel thus preventing any transverse movement of "sloppiness" of the top of the door.

The doors are mounted (rear door first) by inclining the door at a shallow angle, i.e. less than about 15°, with the bottom of the outside face of the door outwardly from the top, and inserting the guides upwardly into the channel with the rib 61 uppermost. This shallow angle does not cause the cheeks 56 to engage the sides of the channel because the rib 59 is provided at the rearward peak of the cheeks and because the rib 61 is located in front of the front edge of the cheeks. Thus for shallow angles the horizontal front to back spacing of the ribs exceeds the horizontal spacing of the cheek extremities.

When the sliders have been inserted into the channels to a position above their normal operating position the door is moved to the vertical position thus causing the tongue 60 to flex upwardly as the rib 61 engages the front surface of the channel. The door is then moved down so that the wheels engage the rubber rail.

The maximum angle of inclination of the door is of course when the cheeks engage the channel and by proper design of the cheeks this maximum angle is kept less than the angle at which the tongue would suffer damage.

Figure 8:
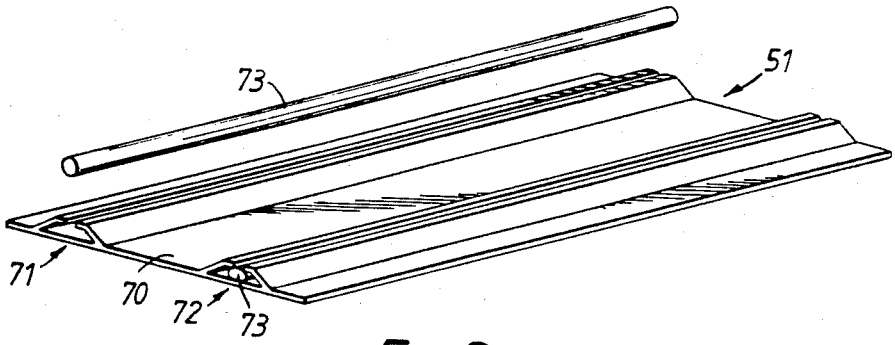
FIG. 8 is a modified bottom wheel track.
Figure 9:
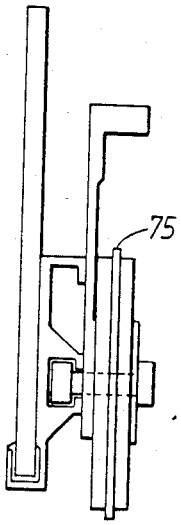
FIG. 9 is a modified weel for use with the track of FIG. 8.

A modified bottom wheel track is shown in FIG. 8. The extrusion 51 is the same comprising a base 70 with the two pairs of flanges is a rubber strip 73 of circular cross section, the spacing of the flanges leaving a gap through which the strip is accessible. In FIG. 9 it can be seen that the wheel has a raised rib 75 at the center of its peripheral surface. In use the rib 75 penetrates between the gap between the flanges and engages the rubber strip while the peripheral wheel surfaces on either side of the rib run on the flange surfaces above the rubber strip.

Figure 10:
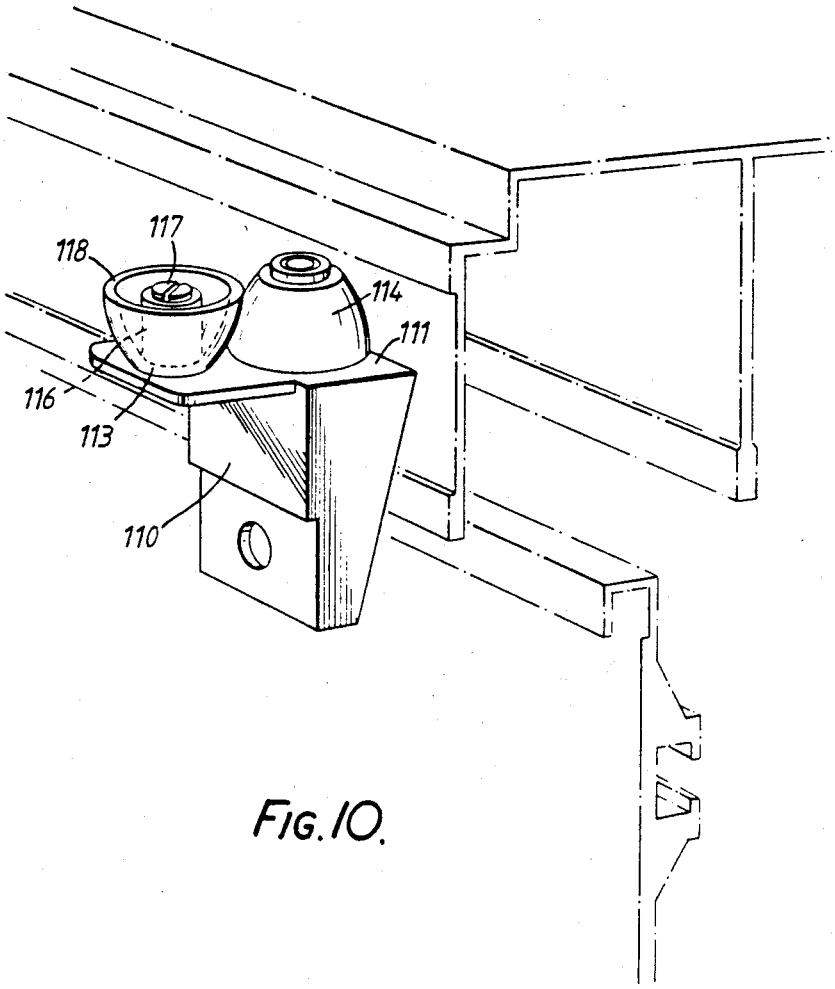
FIG. 10 is a perspective view of a modified guide for the sliding door, having wheels for engaging the top U-shaped guide channel.
Figure 11:
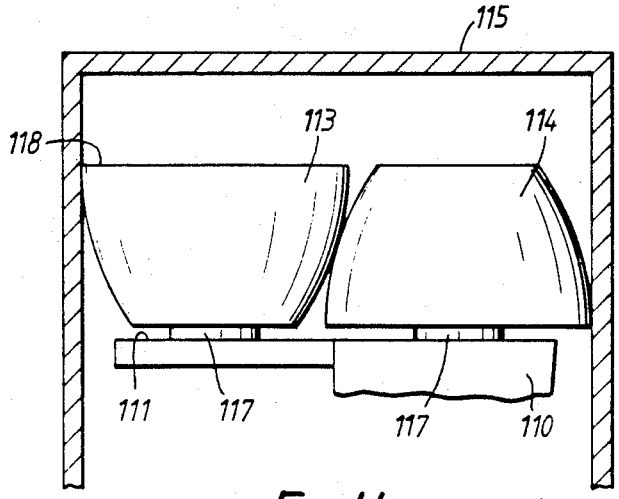
FIG. 11 is an end view of the guide of FIG. 10.

A modified slider or guide is shown in FIGS. 10 and 11, and comprises a body 110 bolted to the top rail of a door which is as previously described. On the top surface 111 of the body are mounted two generally dome shaped rotatable members or wheels 113, 114 which overhang the sides of the body 110 so that the lateral spacing (i.e. in a direction at right angles to the direction of movement of the door) of the extremities of the members 113 and 114 is the greatest lateral dimension of the slider. Each of the wheels has a relatively wider rim at one end and a relatively narrower base at the other end. Thus, the member 113 has the form of an inverted mushroom, a central stalk or hollow boss 116 being rotatable on a vertical hollow post 117 upstanding from the top surface 111 of the body. From the boss a bowl shaped skirt 118 extends upwardly and outwardly to engage one wall of the channel in which the guide moves, giving the outside of the wheel a convex peripheral face. The other wheel 114 is identical to the first wheel 113 except that it is mounted on another hollow post the other way up.

The members 113 and 114 are made of a hard wearing but resilient material such as a synthetic rubber. In use the enlarged rims of the wheels engage and roll along the walls of the channel 115 in which the guide moves. The posts on the body are spaced apart in a direction transverse to the plane of the door a sufficient distance that the dimension between the lateral extremities of the wheels when unstressed is greater than the nominal width of the channel. This ensures that rims of the skirts are deformed by the channel to allow the skirts to compensate for variations in the channel width and remove slackness from the slider movement. The wheel 113 with the larger rim at the top is at the front face of the door and the inverted wheel 114 is at the rear face to best fit the tilt of the door as the top is inserted into the guiding channel.

The spacing between the members 113 and 114 is such that deformation of the skirts causes adjacent portions of the skirts to touch each other, and thus effectively stiffen the skirts, before the lateral overhang of the skirts is reduced to zero, thus protecting the body against contact with the sides of the channel. Portions of the wheels touch each other before the maximum span of the wheels is squeezed to less than the width of the body. This mutual support helps center the guide in the channel and protect the body in the event the channel is a tight fit.

As in the embodiment previously described it should be noted that the guide has its maximum width at the region of the contact of the guide with the sides of the channel, thus allowing the doors to be mounted without the body engaging the sides of the channel.

In a modified embodiment, the wheels, 113 and 114 are solid rather than like a bowl, and are made of a softer deformable polymer such as a soft elastomer or stiff but resilient foam elastomer.

Figure 12:
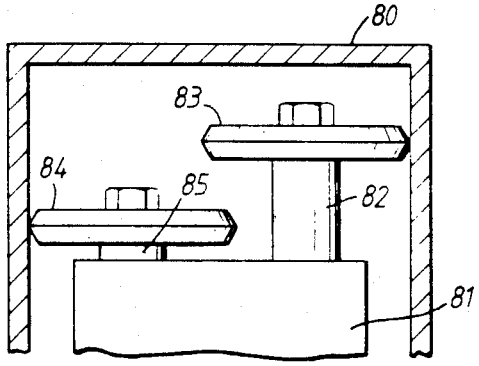
FIG. 12 illustrates another embodiment of guide having wheels extending beyond the faces of the door for engaging the walls of a U-shaped channel.

FIG. 12 illustrates another embodiment of guide for maintaining the top of a sliding door between the walls of a generally U-shaped channel 80. As illustrated in this embodiment a body 81, shown only in a fragmentary schematic view, is attachable to the top of a door (not shown). A relatively taller post 82 is located near the front of the door so that a wheel 83 mounted on the post for rotation about a vertical axis has a rim that engages the inside of the front wall of the U-shaped channel. A second wheel 84 is mounted on a shorter post 85 and has a rim that engages the rear wall of the channel at a lower elevation than the upper wheel 83.

The axes of the two posts are offset so that the rims of the wheels extend beyond the opposite faces of the door for maintaining the top of the door within the channel. Preferably the rim of each of the wheels is resilient to conform to variations in channel width and keep the door from rattling back and forth within the channel. Preferably the rims of the wheels are made of a soft elastomer so as to be resiliently deformable, however, other resilient biasing such as springs may also be employed. Other variations in the inventions described herein will be recognized.

What is claimed is:

1. A guide fittable into a horizontal channel for guiding the top of a sliding door comprising:

a body;

means for attaching the body at the top of a door; and a pair of wheels mounted on the body for rotation about vertical axes spaced apart in a direction transverse to the plane of the door for engaging opposite sides of the channel, each of the wheels having a relatively wider rim at one end and a relatively narrower base at the other end, the wider rim of one wheel being at the top and the wider rim of the other wheel being at the bottom.

2. A guide as recited in claim 1 wherein each of the wheels is generally dome shaped, one of the dome-shaped wheels being upright and the other being inverted.

3. A guide as recited in claim 1 wherein the peripheral face of each of the wheels is convex.

4. A guide as recited in claim 1 wherein the wheels are identical.

5. A guide as recited in claim 1 wherein the rim of each of the wheels is elastically deformable.

6. A guide as recited in claim 1 wherein the wheels are spaced apart from each other and at least one of the wheels is sufficiently deformable that adjacent portions of the wheels touch each other before the maximum span of the wheels from rim to rim is squeezed in a channel to less than the width of the body transverse to the door.

7. A guide as recited in claim 1 wherein each of the wheels is generally bowl-shaped with a hollow interior.

8. A guide as recited in claim 7 wherein each of the bowl-shaped wheels comprises a central hollow stem mounted on an axle on the body.

9. A guide as recited in claim 1 wherein each of the wheels is generally bowl-shaped with a hollow interior.

10. A guide as recited in claim 9 wherein each of the bowl-shaped wheels comprises a central hollow stem mounted on an axle on the body.

11. A guide fittable into a generally U-shaped top channel for guiding a sliding door comprising:

a body;

means for attaching the body at the top of a door;

a first wheel mounted on the body for rotation about a first vertical axis and having a rim sufficiently wide for extending beyond a first face of the door and engaging one wall of the channel at a first height above the top of the door; and a second wheel mounted on the body for rotation about a second vertical axis offset from the first axis in a direction transverse to the plane of a door, and having a rim sufficiently wide for extending beyond the second face of the door and engaging the other wall of the channel at a second height above the top of the door different from the first height.

12. A guide as recited in claim 11 wherein ech of the wheels is generally dome shaped, one of the dome-shaped wheels being upright and the other being inverted.

13. A guide as recited in claim 12 wherein the rim of each of the wheels is elastically deformable.

14. A guide as recited in claim 11 wherein the wheels are spaced apart from each other at least one of the wheels is sufficiently deformable that adjacent portions of the wheels touch each other before the maximum span of the wheels from rim to rim is squeezed in a channel less than the width of the body transverse to the door.

15. A guide fittable into a channel for guiding the top of a sliding door in a channel comprising:

a body;

means for attaching the body at the top of a door; and a pair of wheels mounted on the body for rotation about vertical axes spaced apart in a direction transverse to the plane of the door for engaging opposite sides of the channel, one of the wheels have a widest perimeter of the wheel at a higher elevation above the top of the door and the other wheel having a widest perimeter of the wheel at a lower elevation above the top of the door.

16. A guide as recited in claim 15 wherein each of the wheels is generally dome shaped, one of the dome-shaped wheels being upright and the other being inverted.

17. A guide as recited in claim 15 wherein the wheels are identical.

18. A guide as recited in claim 15 wherein the rim of each of the wheels is elastically deformable.

19. A guide as recited in claim 15 the wheels are spaced apart from ech other and at least one of the wheels is sufficiently deformable that adjacent portions of the wheels touch each other before the maximum span of the wheels from rim to rim is squeezed in a channel to less than the width of the body transverse to the door.

20. A guide as recited in claim 15 wherein each of the wheels is generally bowl-shaped with a hollow interior.

21. A guide as recited in claim 20 wherein each of the bowl-shaped wheels comprises a central hollow stem mounted on an axle on the body.

22. A guide for guiding the top of a sliding door in a channel and comprising a body adapted to be secured to the top of a sliding door for movement in a first direction, first and second members on the body, each of the members having a lateral extremity extending beyond opposite sides of the body in a second direction at right angles to the first direction, the distance between the lateral extremities of the first and second members in the second direction being the greatest dimension of the guide in the second direction, the lateral extremity of one member being at a higher elevation than the lateral extremity of the other member, and at least one of said members being rotatable on the body and having a deformable circumference.

23. A guide as recited in claim 22 wherein the members each comprise a wheel mounted on the body, such a wheel having a relatively larger diameter portion for engaging a wall of the channel and a relatively smaller diameter portion away from the wall.

24. A guide as recited in claim 23 wherein each of the wheels is generally bowl-shaped with a hollow interior, one of the bowl-shaped wheels being upright and the other inverted.

25. A guide as recited in claim 24 wherein the wheels are spaced apart from each other and at least one of the wheels is sufficiently deformable that adjacent portions of the wheels touch each other before the lateral extremities of the wheels deform to less than the width of the body transverse to the door.

* * * * *